US006907763B2

(12) United States Patent
Baulier

(10) Patent No.: US 6,907,763 B2
(45) **Date of Patent: *Jun. 21, 2005**

(54) METHOD FOR HEMMING

(75) Inventor: Dominique Baulier, Windsor (CA)

(73) Assignee: Valiant Corporation, Windsor (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/775,318

(22) Filed: Feb. 10, 2004

(65) Prior Publication Data

US 2004/0159138 A1 Aug. 19, 2004

Related U.S. Application Data

(63) Continuation of application No. 10/133,950, filed on Apr. 26, 2002, now Pat. No. 6,739,169.

(51) Int. Cl.[7] ..... B21D 39/02
(52) U.S. Cl. ..... 72/312; 29/243.58
(58) Field of Search ..... 72/312–315, 386, 72/388; 29/243.58, 243.57, 243.5

(56) References Cited

U.S. PATENT DOCUMENTS 4,484,467 A 11/1984 Kitano et al. ..... 72/379.2
6,257,043 B1 7/2001 Wiens ..... 29/509

FOREIGN PATENT DOCUMENTS

| | | |
|---|---|---|
| DE | 198 40 637 | 3/2000 |
| JP | 56-041032 | 4/1981 |
| JP | 2001-205365 | 7/2001 |
| NL | 1 001 786 | 6/1997 |

*Primary Examiner*—Daniel C. Crane
(74) *Attorney, Agent, or Firm*—Gifford, Krass, Groh, Sprinkle, Anderson & Citkowski, P.C.

(57) ABSTRACT

A method for sharp, crisp hemming inner and outer aluminum sheet metal panels in which a flange is formed along an outer edge so that the flange extends from a bend line and lies in a plane generally perpendicular to the plane of the outer panel. This bend line, furthermore, has an outer radius in the range of (1.0 mm+t)>R>(0.2 mm+t) where t=the thickness of the outer panel. The inner panel is then positioned on the outer panel so that an outer edge of the inner panel is adjacent the bend line. The flange is then bent so that the flange overlies the outer edge of the inner panel while simultaneously compressing the flange in the direction towards the bend line. Thereafter, the flange is compressed against the outer peripheral portion of the inner panel thus completing the hem. The present invention thus achieves a sharp radius bend on the outer edge of the panel with a layer radius bend on the inner panel as well as a class "A" surface on the outer panel adjacent the hem which is free of recoil or other distortion.

4 Claims, 4 Drawing Sheets

Fig-6A
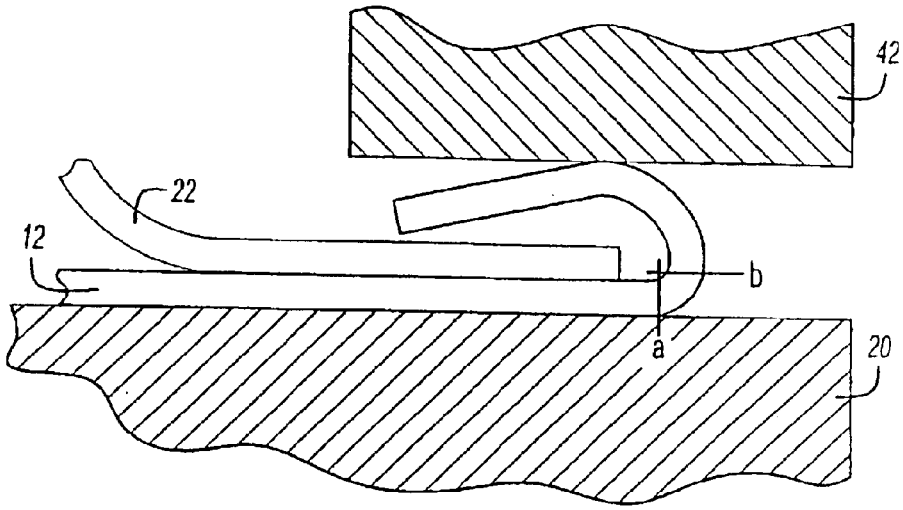
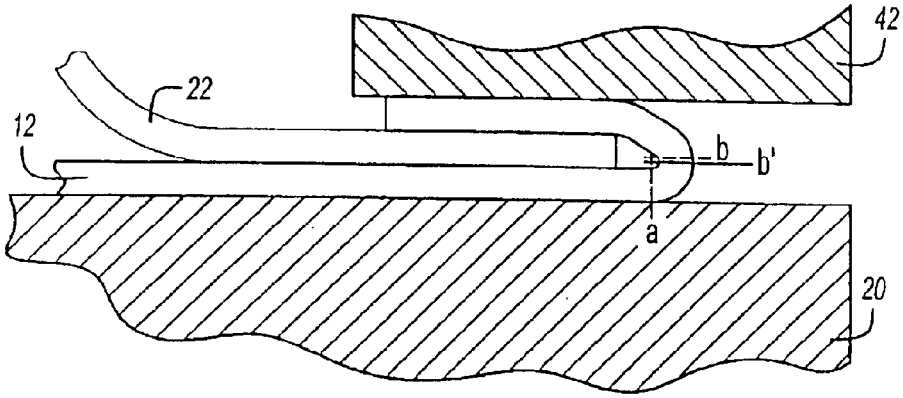
Fig-6B
Fig-7
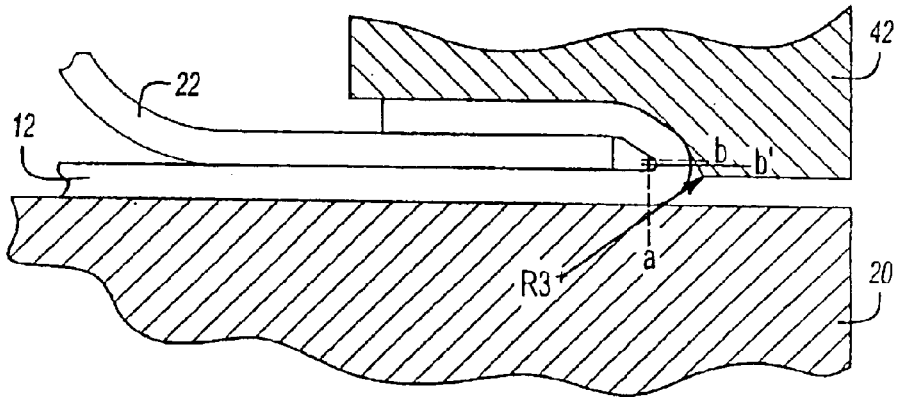

METHOD FOR HEMMING

RELATED APPLICATION

This application is a continuation of U.S. patent application Ser. No. 10/133,950 filed Apr. 26, 2002 now U.S. Pat. No. 6,739,169.

BACKGROUND OF THE INVENTION

I. Field of the Invention

The present invention relates generally to a method for producing a flat hem with a very sharp radius bend between two sheet metal panels for use primarily as automotive closure.

II. Description of Related Art

There are many previously known hemming machines and hemming methods. Many industries, such as the automotive industry, utilize sheet metal hemming machines to secure two metal panels together. For example, in constructing a door for an automotive vehicle, the door typically comprises both an outer panel and an inner panel. In order to secure these panels together, a hem is formed between the inner and outer panel around the outer peripheral edge of the panels such that an outer edge portion of the inner panel is sandwiched in between a flange on the outer panel and the outer panel itself.

In order to perform the hemming operation, there are many previously known hemming machines. These hemming machines typically comprise a base and hemming tooling mounted to the base. A nest is also mounted to the base and the nest and hemming tooling are movable relative to each other. The nest, in turn, supports the panel assembly to be hemmed.

In order to form the hem, a flange is first formed around the outer periphery of the outer panel prior to the hemming operation. This flange, furthermore, lies in a plane that is generally perpendicular or with an angle of 80 degrees to 120 degrees to the plane of the outer panel. Typically, the flange has a width of approximately 6 to 12 mm.

After the flange is formed in the outer panel by a separate flanging operation, the outer panel is then positioned on the nest and the inner panel positioned upon the outer panel so that an outer edge of the inner panel is spaced slightly inwardly from the bend line between the outer panel and its flange. Thereafter, the flange is compressed first against a prehemming tool which bends the flange approximately 45 degrees relative to the plane of the outer panel and so that the flange overlies the outer peripheral portion of the inner panel. The now bent flange is then compressed against the final hemming tool thus sandwiching the outer peripheral portion of the inner panel in between the flange and the outer panel thereby completing the panel assembly.

In order to improve the visual appearance of the hem, many industries, and particularly the automotive industry, have increasingly demanded that the overall hem be as thin as possible. This, in turn, creates a visual optical illusion of decreasing the gap space between the hem and the adjacent panel on the vehicle. Minimization of this apparent gap space between adjacent panels is highly desirable.

Special problems, however, have arisen when hemming the inner and outer panels that are constructed from aluminum sheet metal. As shown in FIG. 1, in these previously known hemming methods, the flange 100 is first formed on the aluminum sheet metal panel 102 so that the outer radius of the bend line 104 between the flange 100 and the remainder of the outer panel 102 is formed at a radius R of approximately 1.2 mm+t where t=the thickness of the aluminum panel. The subsequent hemming operation on such aluminum panels, i.e. compressing the flange initially against the prehemming tooling and subsequently against the final hemming tooling, has created several distinct problems which have previously been unsolved.

With reference to FIG. 2, first, by forming the flange with a relatively large radius, i.e. 1.2 mm plus the thickness of the panel 102, compression of the flange 100 against a conventional 45 degrees prehemming tooling 106 causes the bend line 104 to creep inwardly from the position shown in phantom line and to the position shown in solid line by the distance X relative to the panel 102. Such "creeping" during the prehemming operation also causes the outer panel to roll upwardly along its outer edge so that the panel 102 begins to bend a position spaced inwardly by the distance Y from the bend line 104. This in turn provides the visual appearance of a relatively wide gap space between the adjacent panels following assembly on the automotive vehicle, as well as distortions like "recoil" that the final hemming operation cannot correct.

With reference to FIG. 3, a second, and perhaps more serious, disadvantage of these previously known hemming methods is that the formation of the flange 100 causes the aluminum panel to become more brittle along the bend line 104 between the flange 100 and the remainder of the outer panel 102. The subsequent final hemming operation causes a further compression of the flange 100 and movement of the flange 100 along its bend line 104. This further compression of the flange and movement along its bend line causes the aluminum panel to crack along the bend line during the hemming operation as shown at 110. Such cracking is unacceptable for the automotive industry as well as other industries.

A still further disadvantage of the relatively large radius used to form the flange with the previously known hemming methods is that the final position of the bend line and thus the outer periphery of the final panel assembly will vary slightly following the hemming operation. Such movement of the bend line of the flange can result from either inward creeping of the bend line or outward compression of the flange bend line during the final hemming operation. Such movement of the outer bend line disadvantageously results in inconsistent gap spacing between adjacent panels on the resulting automotive vehicle.

SUMMARY OF THE PRESENT INVENTION

The present invention provides a hemming method which overcomes all of the above-mentioned disadvantages of the previously known hemming methods.

In brief, the method of the present invention first forms the flange along the outer periphery of the outer panel so that a bend line separates the flange from the remainder of the outer panel and also so that the flange lies in a plane substantially perpendicular to the plane of the remainder of the outer panel. Unlike the previously known hemming methods, however, the bend line between the flange and the remainder of the outer panel has an outer radius R in the range of (1.0 mm+t)>R>(0.2 mm+t) where t=the thickness of the outer panel in millimeters. Consequently, unlike the previously known flanging operations used in preparation for the subsequent hemming operation, the flanging operation of the present invention provides a very sharp bend along the bend line between the flange and the remainder of the outer panel.

This sharp bend can further be more easily achieved during the flanging operation which is a part of the stamping process, because every side of both outer panel and flange can be closely and accurately trapped in between the different part of the die set. At the opposite, a hem press will have access to only the outer surface of the outer panel (nest on class "A" surface, and upper steel on outside of the flange). Most of such traditional hemmer using the edge of the inner panel as a "counter-anvil" to impose the real "breaking line" of the hem. Consequently, any variation in the location of the inner edge will fatally impact on the final geometry of the hemmed part. Unlike the previously known hemming operation, the present invention accurately freezes the final geometry of the outer perimeter of the door right from the stamping operation, and uses the inner panel only like a pure spacer in the hem stack-up. Its position is no more critical.

Following the flanging operation, the outer panel is positioned on the nest of a hemming machine in the conventional fashion. The inner panel is then positioned on the outer panel in the conventional fashion so that an outer periphery of the inner panel is adjacent to but spaced inwardly from the bend line around the outer panel. Thereafter, the nest is sequentially reciprocated relative to prehemming and final hemming tooling to hem the inner and outer panels together.

Unlike the previously known hemming methods using a prehem tool with a pure linear section oriented at 45 degrees, however, the hemming method of the present invention utilizes a prehemming tooling having a radius $R_2$ of curvature in the range of $2L>R_2>\frac{1}{3}L$ where L equals the width of the flange. By utilizing a prehemming tool having such a radius, the initial angle of impact between the prehemming tool and the free edge of the flange is in the range of 55 degrees to 70 degrees and thus much sharper than the previously known 45 degrees prehemming tools. This high angle of impact between the curvilinear prehemming tool and the outer free edge of the flange of the present invention effectively imparts a force on the flange between the prehemming tool and in a direction towards the bend line between the flange and the remainder of the outer panel. In practice, this force effectively retains the bend line in a fixed position relative to the outer panel during the entire prehemming operation.

As a consequence, the class "A" surface of the outer panel remains perfectly in contact with the anvil during the complete process of prehemming without performing any parasite bending in between the sharp bend to perform the flanging and the class "A" surface. The sharp bend early performed from flanging contributes at this turn to avoid any risk of class "A" surface buckling under the important axial force applied on the hem flange during the prehem operation. A traditional (1.2 mm+t) flanging rad will conduct to such situation, and preferably a 0.8 mm+t to 0.5 mm+t flanging rad will be preferred to generate during the prehem only one large curvature just above the initial bend and only the straight hem flange.

Following the prehemming operation, the flange overlies a portion of the outer peripheral portion of the inner panel and is curvilinear in the shape conforming substantially to the shape of the prehemming tooling. Thereafter, final hemming tooling compresses the flange against the outer peripheral portion of the inner panel thus sandwiching the outer peripheral portion of the inner panel between the flange and the remainder of the outer panel and completing the hem for the final panel assembly. In practice, flat final hemming tooling will achieve the desired final appearance for the hem.

During the final hem operation, the first part next to the initial hem bend of the large curvature performed on the flange during the prehem operation is curved even sharper by the compression of the final hem steel. When at the opposite, the second part is flattened against the inner panel developing a spring-back force firmly trapping in position the inner panel.

The present invention, by its use not only of the initial flanging operation with a sharp bending radius between the flange and the remainder of the outer panel, but also by the use of the curvilinear prehemming tool, ensures that the outer bend line for the outer panel remains fixed during the entire hemming operation. By so fixing the position of the outer bend line, cracking of the outer panel along the bend line is avoided and panels of predictable and consistent sizes are obtained. As a further advantage, the present invention eliminates essentially all creeping of the outer panel during the prehemming operation as well as any recoil resulting of this initial creeping when performing the final hem. By eliminating such creeping, the overall visual appearance of a very thin hem is obtained.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIGS. 6A and 6B are diagrammatic side views illustrating a final hemming operation in accordance with the preferred method of the present invention; and FIG. 7 is a view similar to FIG. 6B, but illustrating a modification thereof.

DETAILED DESCRIPTION OF A PREFERRED METHOD OF THE PRESENT INVENTION

Figure 1:
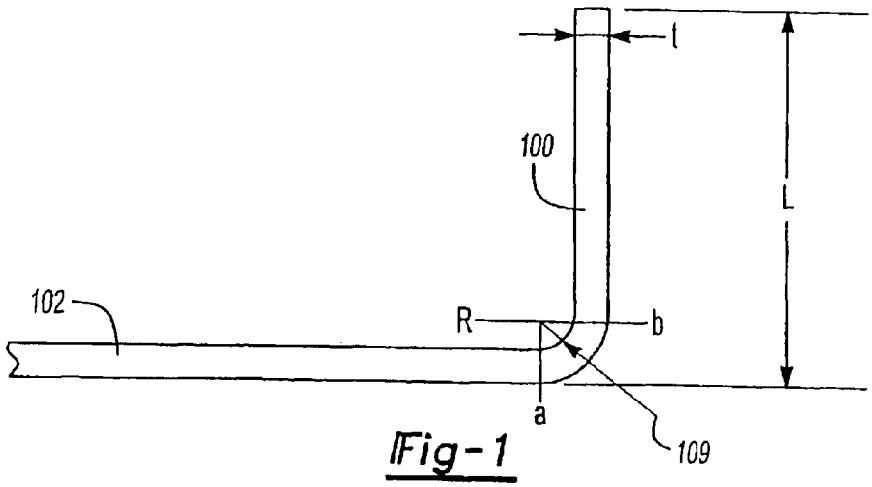
Fig-1 PRIOR ART
FIG. 1 is a prior art view illustrating an outer panel following the flanging operation.
Figure 2:
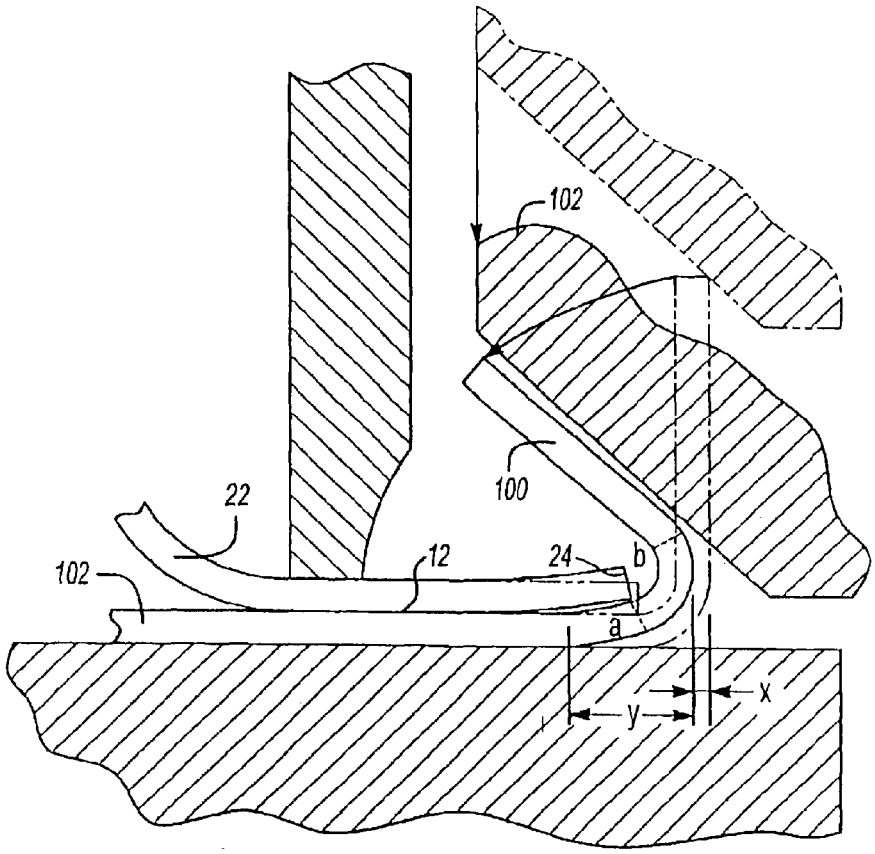
Fig-2 PRIOR ART
FIG. 2 is a sectional view illustrating the prior art hemming method during a prehemming operation.
Figure 3:
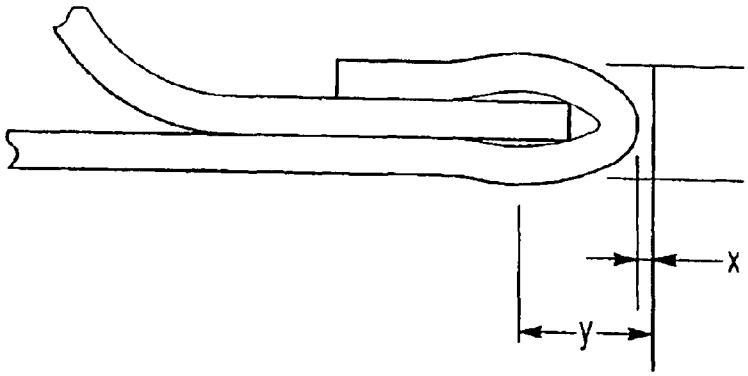
Fig-3 PRIOR ART
FIG. 3 is a side view illustrating a prior art panel assembly following a hemming operation.
Figure 4:
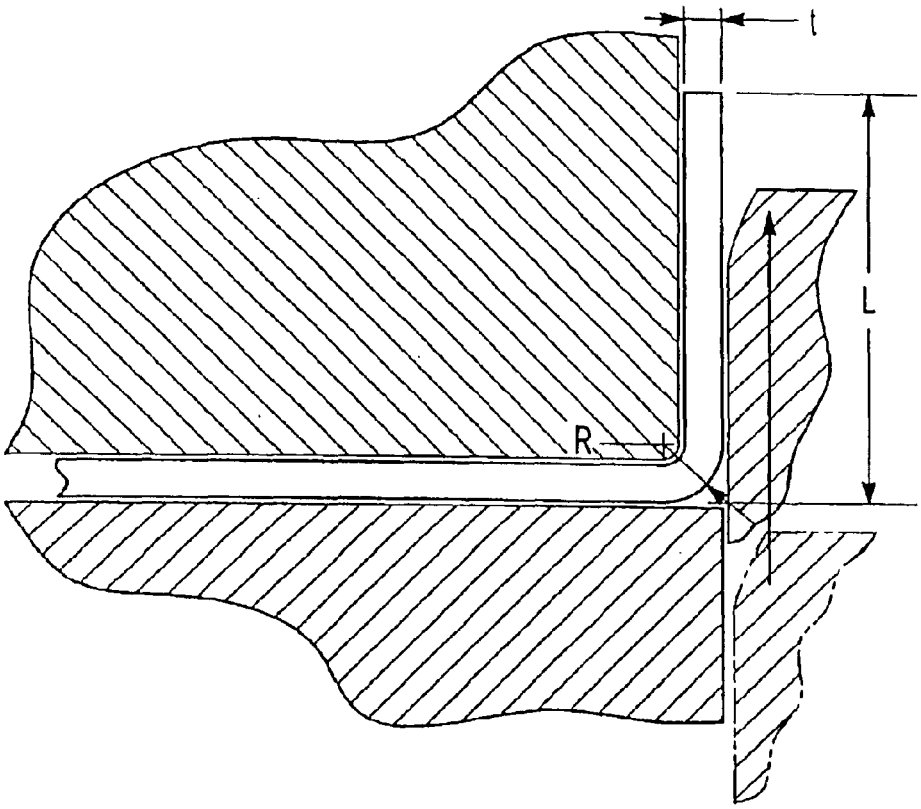
FIG. 4 is a fragmentary side view illustrating a portion of the outer panel following a flanging operation in accordance with a preferred method of the present invention.

With reference first to FIG. 4, during the hemming method of the present invention, a flange 10 is first formed around an outer peripheral portion of an outer panel 12. Consequently, the flange 10 extends from a bend line 14 formed in the outer panel 12 such that the flange 10 lies in a plane generally perpendicular to the plane of the remainder 16 of the outer panel 12. The flange 10, furthermore, has an overall width of L.

Unlike the previously known hemming methods, the bend line 14 has an outer radius R in the range of (1.0 mm+t) >R>(0.2 mm+t) where t=the thickness of the outer body panel 12. Since aluminum panels 12 are generally from 0.8 mm to 1.2 mm in thickness, the radius R between the flange 10 and remainder 16 of the outer panel 12 along the bend line 14 will be typically in the range of 1.4 mm to 2.2 mm for a 1.2 mm thick panel.

Figure 5A:
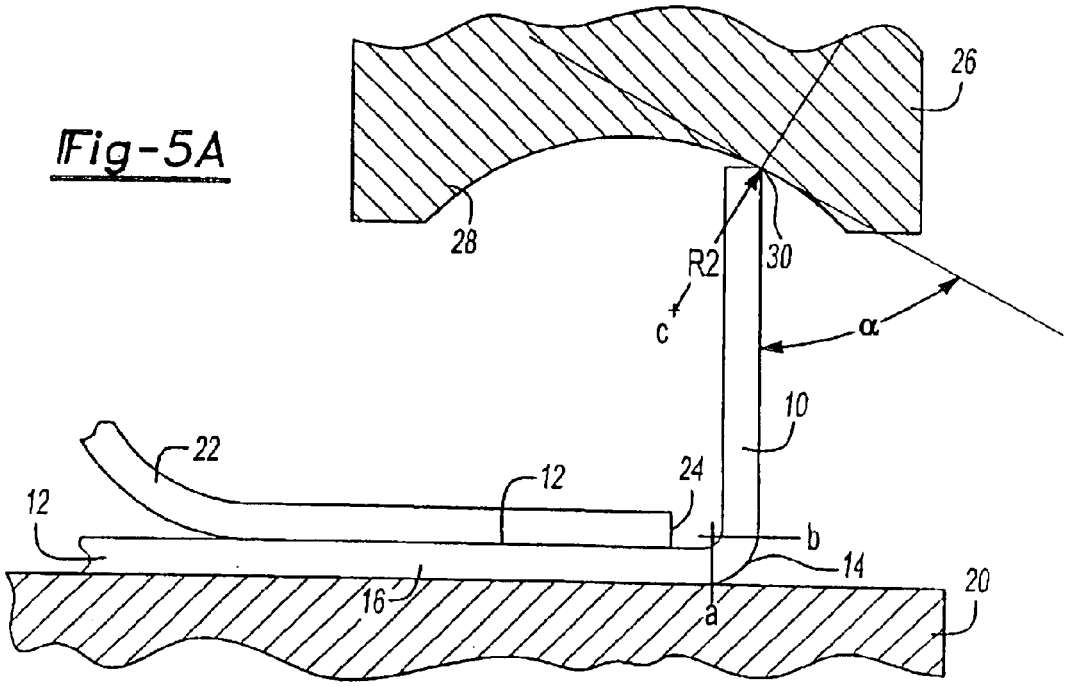
FIGS. 5A and 5B are side diagrammatic views illustrating a prehemming operation in accordance with the method of the present invention.
Figure 5B:
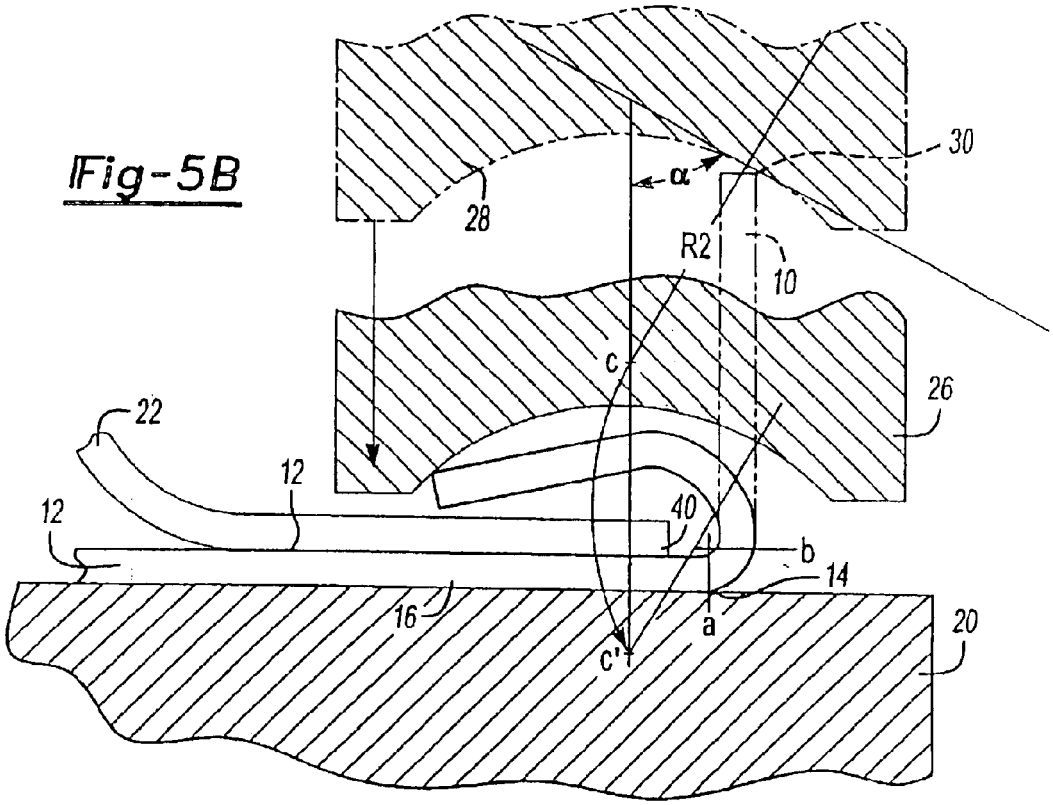

With reference now to FIGS. 5A and 5B, following the flanging operation, the outer panel 12 is positioned on a nest 20 (illustrated only diagrammatically) of a hemming machine. An inner body panel 22 is then positioned on the outer panel 12 in a conventional fashion so that an outer edge 24 of the inner panel 22 is spaced slightly inwardly from the bend line 14 between the flange 10 and remaining portion 16 of the outer panel 12.

Still referring to FIGS. 5A and 5B, unlike the previously known hemming methods, the hemming method of the present invention utilizes a prehemming tool 26 having a curvilinear hemming surface 28 which is formed along the radius $R_2$. The radius $R_2$, furthermore, is in the range of ⅓ L to 2L where L equals the width of the flange 10.

As best shown in FIG. 5A, the prehemming tool 26 is positioned relative to the flange 10 so that, at the initial impact between an outer free edge 30 of the flange 10 and the hemming surface 28 of the prehemming tool 26, the angle of impact $\alpha$ is in the range of 55 degrees to 70 degrees and thus much greater than the previously known 45 degrees for prehemming tools. This increased angle $\alpha$ between the prehemming tool 26 and the flange 10 causes the prehemming tool 26 to compress the flange 10 in the direction from its free edge 30 towards its bend line 14 during the prehemming operation, i.e. as the prehemming tool 26 moves from the position shown in FIG. 5A and to the position shown in FIG. 5B. This compression thus ensures that the bend line 14, and thus the outer periphery of the final panel assembly, remains in a fixed position during the entire prehemming operation thereby eliminating the previously known "creeping" common to prior art hemming methods.

At the end of the prehem operation, the originally straight part of the flange 10 will be bent with a large bending curvature starting just above the initial flange bend.

With reference now to FIGS. 6A and 6B, following the prehemming operation (FIG. 6A) the flange 10 is bent so that it overlies an outer edge portion 40 of the inner panel 22. Furthermore, the flange 10 will build a large curvature inside of the prehemming tool 26 illustrated in FIG. 5A and FIG. 5B.

Thereafter, the nest 20 is reciprocated relative to a final hemming tool 42 from the position shown in FIG. 6A and to the position shown in FIG. 6B. In doing so, the final hemming tool 42 compresses the flange 10 thus sandwiching the outer edge portion 40 of the inner panel 22 between the flange 10 and the remainder 16 of the outer panel as shown in FIG. 6B.

Preferably, the final hemming tooling 42 has a flat hemming surface 44 which is generally parallel to the support surface of the nest 20. The use of a final hemming tool 42 with a flat hemming surface 44 is relatively inexpensive to manufacture and renders the inner and outer positions of the final hemming tool 42 relative to the flange 10 essentially noncritical. However, if desired, the final hemming tool 42 can include a shaped surface 46 (FIG. 7) such that the surface 46 corresponds in shape to the desired final hem.

A primary advantage of the present invention is that, due to the sharp bend between the flange and the remainder of the outer panel accurately performed during the flanging operation coupled with the curvilinear prehemming tool, movement and further compression of the outer panel along its bend line is virtually eliminated. This, in turn, eliminates both creeping and recoil, as well as risk of cracking of the outer panel during the hemming operation.

Having described my invention, however, many modifications thereto will become apparent to those skilled in the art to which it pertains without deviation from the spirit of the invention as defined by the scope of the appended claims.

I claim:

1. A method for hemming two aluminum sheet metal panels together wherein one panel has a generally perpendicular flange with a width L from a bend line on said one panel and to a free edge of said one panel, comprising the steps of:

positioning an outer edge of the other panel adjacent said bend line;

bending said flange so that said flange overlies the outer edge of said other panel; and thereafter compressing said flange against an outer peripheral portion of said other panel so that said outer peripheral portion of said other panel is sandwiched in between said flange and said one panel;

wherein said bending step further comprises the step of impacting a curvilinear prehemming tool against an outer edge of said flange, said prehemming tool has a curvilinear surface with a radius $R_2$ where $R_2$ is in the range of $2L>R_2>\frac{1}{3}L$ and wherein said curvilinear surface of said prehemming tool maintains contact with the free edge of the flange throughout said bending step; and wherein said generally perpendicular flange has an outer bending radius R in the range of (1.0 mm+t)>R>(0.2 mm+t), where t=thickness of said one of said panels in millimeters.

2. The invention as defined in claim 1 wherein said curvilinear surface of said prehemming tool, upon initial contact between said prehemming tool and the outer edge of said flange, the angle between the plane of said flange and a tangent of said prehemming tool is in the range of 55 to 70 degrees.

3. The invention as defined in claim 1 wherein said curvilinear surface of said prehemming tool, upon initial contact between said prehemming tool and the outer edge of said flange, the angle between the plane of said flange and a tangent of said prehemming tool is in the range of 55 to 70 degrees.

4. A method for hemming two aluminum sheet metal panels together wherein one panel has a generally perpendicular flange with a width L from a bend line on said one panel and to a free edge of said one panel, comprising the steps of:

positioning an outer edge of the other panel adjacent said bend line;

bending said flange so that said flange overlies the outer edge of said other panel; and thereafter compressing said flange against an outer peripheral portion of said other panel so that said outer peripheral portion of said other panel is sandwiched in between said flange and said one panel;

wherein said bending step further comprises the step of impacting a curvilinear prehemming tool against an outer edge of said flange, said prehemming tool has a curvilinear surface with a radius $R_2$ where $R_2$ is in the range of $2L>R_2\frac{1}{3}L$ and wherein said curvilinear surface of said prehemming tool maintains contact with the free edge of the flange throughout said bending step; and wherein said curvilinear surface of said prehemming tool, upon initial contact between said prehemming tool and the outer edge of said flange, the angle between the plane of said flange and a tangent of said prehemming tool is in the range of 55 to 70 degrees.

* * * * *

UNITED STATES PATENT AND TRADEMARK OFFICE

CERTIFICATE OF CORRECTION

PATENT NO. : 6,907,763 B2
DATED : June 21, 2005
INVENTOR(S) : Dominique Baulier

It is certified that error appears in the above-identified patent and that said Letters Patent is hereby corrected as shown below:

Column 6,
Line 56, replace "2L>$R_2$1/3 L" with -- 2L>$R_2$>1/3L --.

Signed and Sealed this

Fourth Day of October, 2005

JON W. DUDAS
*Director of the United States Patent and Trademark Office*